US007194936B2

(12) United States Patent
Engel et al.

(10) Patent No.: US 7,194,936 B2
(45) Date of Patent: Mar. 27, 2007

(54) SLIDABLE SWITCHING MECHANISM FOR CONVERTIBLE RETAINING RING PLIERS

(75) Inventors: Bruce J. Engel, Milwaukee, WI (US); James W. Murphy, Kerrville, TX (US); Larry F. Gerbert, Ingram, TX (US)

(73) Assignee: A&E Manufacturing Company, Racine, WI (US)

( * ) Notice: Subject to any disclaimer, the term of this patent is extended or adjusted under 35 U.S.C. 154(b) by 115 days.

(21) Appl. No.: 11/156,929

(22) Filed: Jun. 20, 2005

(65) Prior Publication Data

US 2006/0283291 A1 Dec. 21, 2006

(51) Int. Cl.

| | |
|---|---|
| ***B25B 7/12*** | (2006.01) |
| ***B25B 7/04*** | (2006.01) |
| ***B25B 11/00*** | (2006.01) |
| ***B25B 25/00*** | (2006.01) |
| ***B23P 19/04*** | (2006.01) |

(52) U.S. Cl. ..... 81/302; 81/341; 81/486; 81/485; 29/229

(58) Field of Classification Search ..... 81/302, 81/341, 486, 485, 416, 405, 406, 394, 411; 29/229, 225

See application file for complete search history.

(56) References Cited

U.S. PATENT DOCUMENTS

| | | | | |
|---|---|---|---|---|
| 4,280,265 | A * | 7/1981 | Murphy | 29/229 |
| 4,476,750 | A | 10/1984 | Murphy | |
| 6,470,774 | B2 * | 10/2002 | Chang | 81/302 |
| 6,983,677 | B1 * | 1/2006 | Engel | 81/302 |

* cited by examiner

*Primary Examiner*—Joseph J. Hail, III
*Assistant Examiner*—Bryan R. Muller
(74) *Attorney, Agent, or Firm*—Andrus, Sceales, Starke & Sawall, LLP

(57) ABSTRACT

A convertible retaining ring pliers has a pivot, first and second jaws and first and second handles rotatably secured about the pivot. A pair of transfer pins is slidably disposed for selective movement in the jaws and the handles for establishing alternative operating positions enabling the jaws to move either inwardly or outwardly as the handles move inwardly. A switching mechanism is provided for simultaneous shifting of the transfer pins in the jaws and the handles. The switching mechanism includes reaction member housing assemblies which are mounted on opposite ends of the pivot and disposed on opposite external surfaces of the handles. A switchplate structure is rotatably mounted for side-to-side movement about the pivot, and is slidably positioned between at least one reaction member housing assembly and the external surface of one of the handles. The switchplate structure is engagable with an internal portion and an external portion of the at least one reaction member housing assembly, and an end of one of the transfer pins.

18 Claims, 9 Drawing Sheets

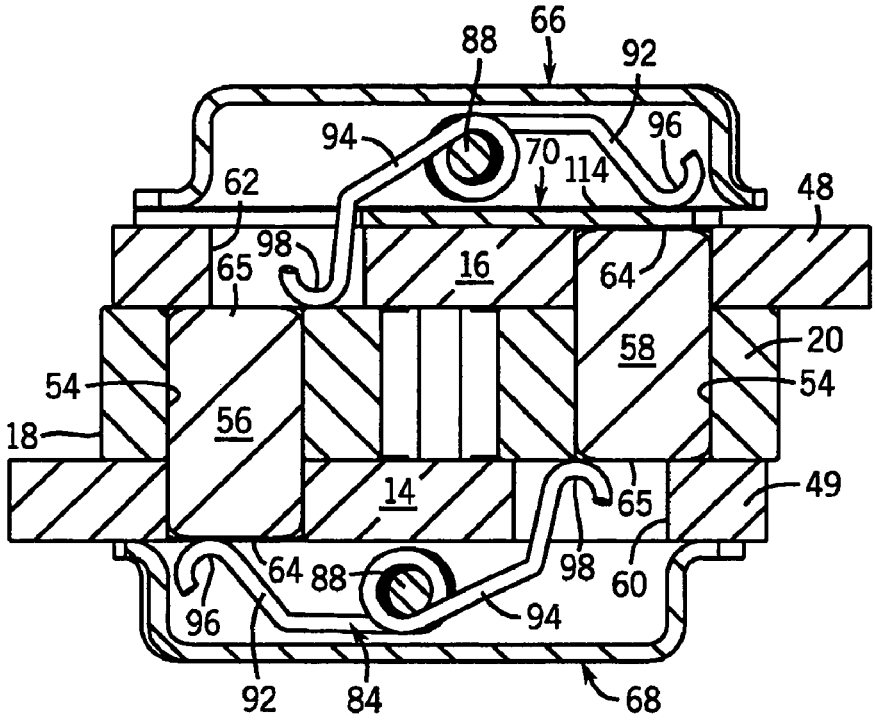
FIG. 8
FIG. 9
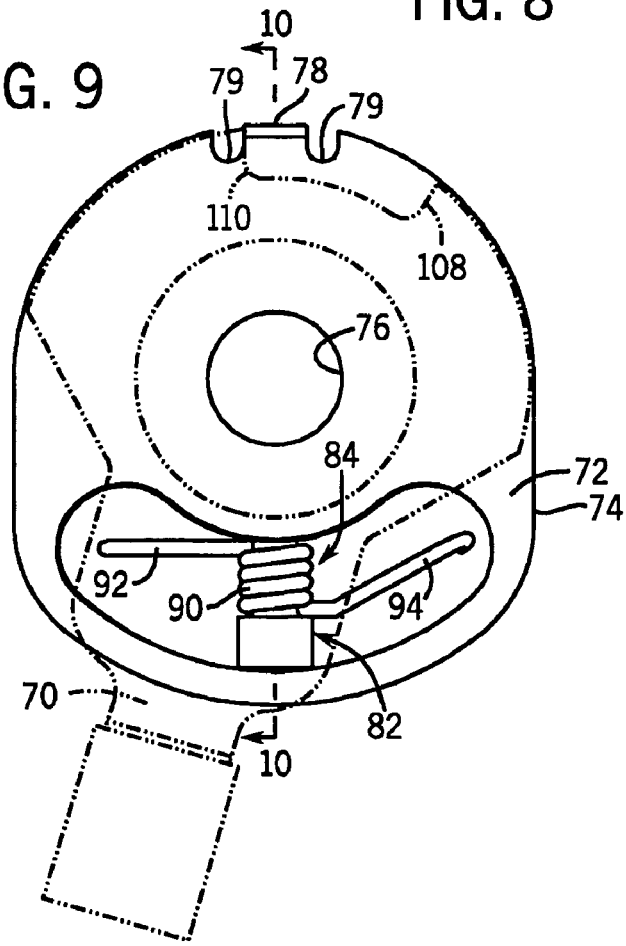
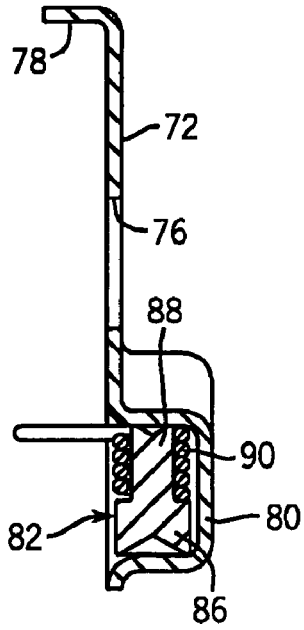
FIG. 10

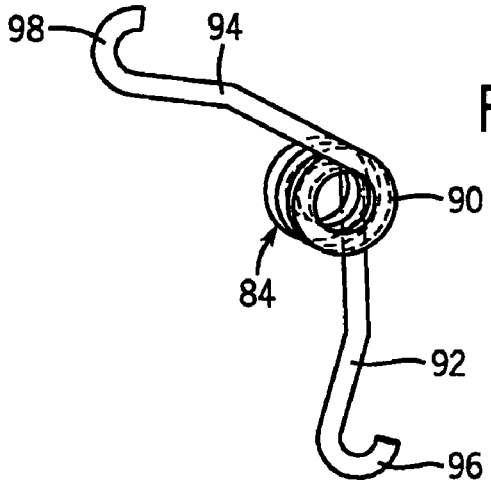
FIG. 11
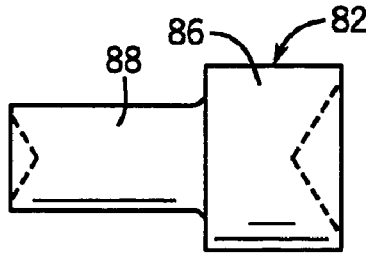
FIG. 12
FIG. 13
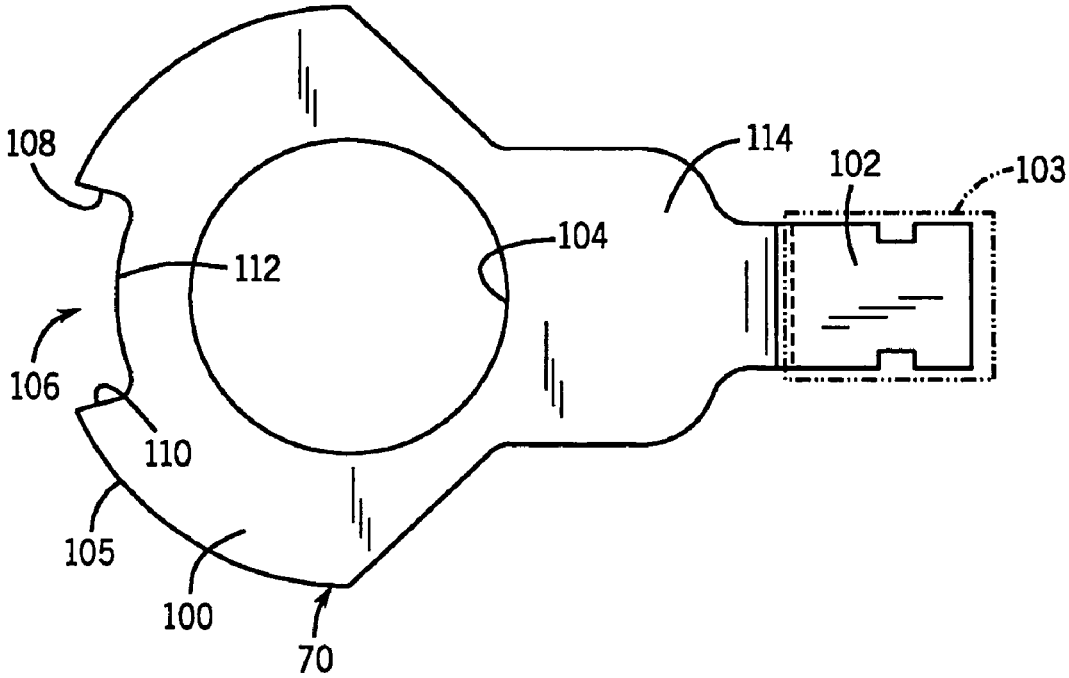

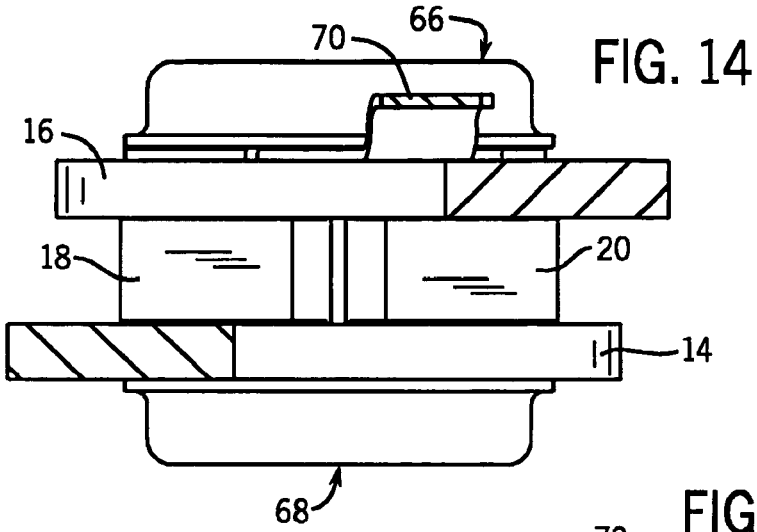
FIG. 14
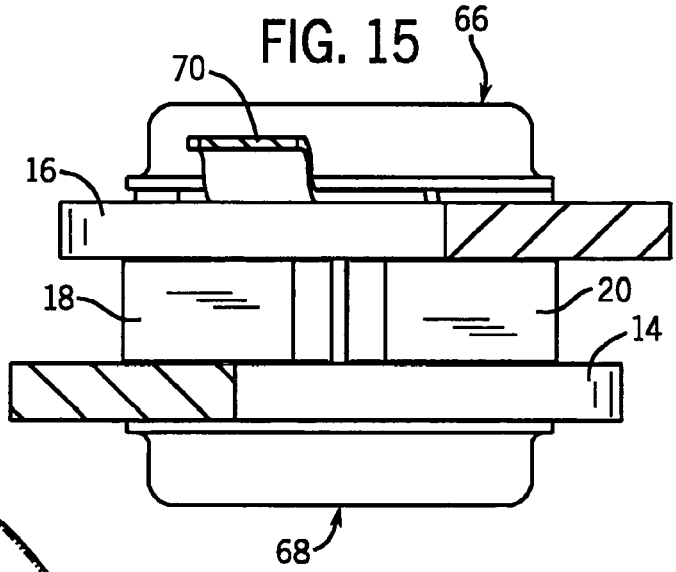
FIG. 15
FIG. 16
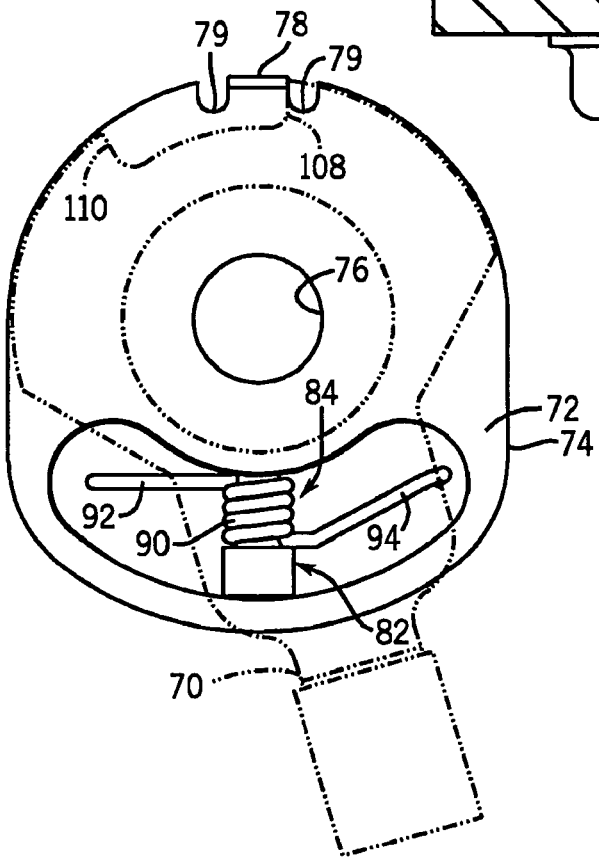

SLIDABLE SWITCHING MECHANISM FOR CONVERTIBLE RETAINING RING PLIERS

FIELD OF THE INVENTION

The present invention relates broadly to retaining ring pliers used to remove and replace both internal and external retaining rings. Such pliers are convertible between a first position which allows the jaws to move inwardly as the handles are moved inwardly, and a second position which enables the jaws to move outwardly as the handles are moved inwardly. More, particularly, the invention relates to a slidable switching mechanism provided on the retaining ring pliers to more easily effect the transfer between the first and second positions.

BACKGROUND OF THE INVENTION

Retaining rings are utilized in annular grooves on shafts and ends of shafts to retain bearings, collars and the like on the shaft. A retaining ring extends circumferentially between a pair of ends which have hubs. The hubs have apertures which receive tips of a plier tool. The force applied by the pliers either spread the hubs to expand the ring or squeezes the hubs to contract the ring. The plier tool is necessary for installing the retaining ring in and removing the retaining ring from either external or internal grooves.

Accordingly, it is sometimes desirable to squeeze the handles to effect movement of the jaws outwardly to expand the ring. It is at other times desirable to squeeze the handles to effect movement of the jaws inwardly to contract the ring. Thus, it is desirable to provide a pliers that is convertible between an external and an internal tool. U.S. Pat. Nos. 4,280,265 and 4,476,750 disclose a pair of retaining ring pliers that utilize a pair of separate co-planar jaws and a pair of separate handles that range about a common fixed pivot point and that are adapted to be changed to alternately engage one handle to one jaw and the other handle to the other jaw and vice versa to permit the changing of the tool from external to internal and vice versa. Two fulcrum or transfer pins of a latching arrangement are disposed in the jaws and are adapted to alternately engage each set of the handles to shift from a position adapted to move the jaws inwardly as the handles are moved inwardly, and to a position where the jaws are moved outwardly as the handles are moved inwardly.

The prior art retaining ring pliers in the '265 and the '750 patents require that a user have a dull pointed instrument, such as a pen, nail or screwdriver, handy to forcefully push the pins between their alternate positions. Specifically, the user would have to squeeze the handles of the pliers inwardly to align the transfer pins of the latching arrangement with the holes formed in the handles, and then use the pointed instrument to push the pins from each respective side of the pliers. Thus, each of the transfer pins disclosed in the above-noted patents has to be independently placed in the correct position using an additional tool.

A convertible retaining ring pliers that does not require another instrument or tool to convert the pliers between internal and external modes is disclosed in U.S. patent application Ser. No. 10/818,251 filed Apr. 5, 2004 by the assignee of this application. In this design, a switching mechanism is mounted to the plier's handles and pivot for providing simultaneous shifting of the transfer pins in the jaws and handles between first and second operating positions. The switching mechanism includes a first flexing spring plate disposed on an external surface of the first handle, and a second flexing spring plate disposed on an external surface of a second handle. Each of the spring plates have a pair of boss pins engageable with opposite ends of the transfer pins. Finger pressure is simultaneously applied to the ends of the spring plates while the handles are moved inwardly to simultaneously shift the transfer pins between the first and second operating positions.

Accordingly, it is desirable to provide a convertible retaining ring pliers that does not require another instrument or tool to convert the pliers from internal to external mode and vice versa. It is further desirable to provide a relatively simple switching mechanism which does not require finger pressure to be simultaneously applied to the transfer pins from each side of the pliers, while the handles are moved inwardly to align the transfer pins with the proper holes in the handles. It is preferable that the simultaneous movement of the transfer pins will make the conversion faster and more efficient than previous models with far less complexity required in the pliers structure.

SUMMARY OF THE INVENTION

It is one object of the present invention to provide a switching mechanism in a convertible retaining ring pliers for selectively and alternatively joining relative moveable external members to a common internal member in a more efficient manner.

It is also an object of the present invention to provide a switching mechanism in a retaining ring pliers to enable simultaneous shifting of the transfer pins.

It is a further object of the present invention to provide a switching mechanism in a retaining ring pliers which provides a user with an enhanced visual indication of the operating position of the pliers.

It is an additional object of the present invention to provide a switching mechanism in a retaining ring pliers where the mechanism includes at least one slidable switchplate actuated by a single finger to provide for the simultaneous shifting of the transfer pins and hold the transfer pins in their desired operating positions.

Another object of the present invention is to provide a retaining ring pliers switching mechanism which has a minimum of parts and is simple to assemble and operate.

In one aspect of the invention, a retaining ring pliers includes a pivot assembly and first and second jaws arranged for oscillation toward and away from each other about the pivot assembly. The handles have portions adjacent to the pivot assembly disposed on respective opposite sides of the jaws. A transfer pin is slidably disposed in each jaw for alternative engagement with one or the other of the handle portions. The transfer pins are disposed in transverse bores in the jaws having axes parallel to the axis of the pivot assembly. Each of the handle portions has a pair of spaced holes disposed to receive the transfer pins. The transfer pins in the first and second jaws are selectively slidably engaged in the holes of respective first and second handles to effect movement of the jaws toward each other when the handles are moved towards each other to define a first operating position. The transfer pins in the first and second jaws are selectively slidably engaged in the holes of respective second and first handles to effect movement of the jaws away from each other as the handles are moved towards each other to define a second operating position.

The pliers is improved by means of a switching mechanism mounted to the pivot assembly and in contact with external surfaces of the handle portions and the transfer pins to enable simultaneous shifting of the transfer pins in the first and second jaws and holes of the first and second handles. The switching mechanism includes a first reaction member housing assembly disposed above the external surface of one handle portion, a second reaction member housing assembly disposed on the external surface of the other handle portion and a switchplate structure rotatably mounted for side-to-side movement about the pivot assembly and slidably positioned between at least one reaction member housing assembly and at least one of the external surfaces of the handle portions. The switchplate structure is engagable with an internal portion and an external portion of the at least one reaction member housing assembly and an end of one of the transfer pins.

Each reaction member housing assembly includes a cover provided with a domed portion for retaining a reaction member having a central portion rotatably mounted about a pin. In one embodiment, each reaction member is a spring having a coiled central portion. The spring further includes a pair of oppositely extending spring arms joined to the coiled central portion. Each spring arm terminates in a curled end. Each curled end of the spring in the second reaction member housing is engaged under stress with one of the transfer pins. Each cover includes a thin plate having a central aperture receiving the pivot assembly, and a switchplate-engaging tab extending generally perpendicularly from the thin plate. Each handle is formed with a vertical channel for receiving the tab therein. One curled end of the spring in the first reaction member housing assembly is engaged with the switchplate structure, and the other curled end of the spring in the first reaction member housing assembly is engaged with a transfer pin. The switchplate structure has a first flat portion lying between the cover and the external surface of the one handle portion, and a second flat portion offset from the first flat portion and defining an actuator adapted to be engaged by a single finger when it is desired to move the switchplate structure. The switchplate structure is formed with a recess having a pair of spaced apart sidewalls, each of which is engagable with the tab on the cover when the switchplate structure is moved from side-to-side. The switchplate structure includes either one or two switchplates. In another embodiment, one reaction member is a spring and the other reaction member is a solid, nonflexible rocker.

In another aspect of the invention, a convertible retaining ring pliers includes a pivot, and first and second jaws as well as first and second handles rotatably joined about the pivot. A pair of transfer pins is slidably disposed for selective movement in the first and second jaws and the first and second handles for establishing a first operating position enabling the jaws to move inwardly as the handles move inwardly, and a second operating position allowing the jaws to move outwardly as the handles move inwardly. A switching mechanism is mounted to the handles at the pivot for providing simultaneous shifting of the transfer pins in the jaws and handles between the first and second operating positions. The switching mechanism includes a first reaction member housing assembly mounted to one end of the pivot and disposed above an external surface of the handle, a second reaction member housing assembly mounted to an opposite end of the pivot and disposed on an external surface of the second handle and a switchplate structure rotatably mounted about the pivot and slidably positioned between at least one reaction member housing assembly and one of the external surfaces of the handle portions. Each reaction member housing assembly has a cover for retaining a spring having a central coiled portion with a pair of oppositely extending spring arms, and a spring pin about which the coiled portion of the spring is rotatably disposed. In each operating position, the switchplate structure is engaged with one of the spring arms, the cover of the at least one reaction member housing assembly and an end of one of the transfer pins.

The invention further contemplates a method of converting a retaining ring pliers having a pivot, first and second jaws rotatably secured to the pivot, first and second handles rotatably joined about the pivot, and a pair of transfer pins slidably disposed for selective movement in the first and second jaws and the first and second handles between one operating position enabling the jaws to move inwardly as the handles move inwardly, and a second operating position enabling the jaws to move outwardly as the handles move inwardly. The method includes the steps of mounting a first reaction member housing assembly having a reaction member with at opposite ends to one end of the pivot such that the first reaction member housing assembly is disposed above an external surface of the first handle; mounting a second reaction member housing assembly having a second reaction member with opposite ends to an opposite end of the pivot such that the second reaction member housing assembly is disposed on an external surface of the second handle and the opposite ends of the second reaction member are engagable under stress with ends of the transfer pins; and mounting a switchplate structure for limited rotation about the pivot so that the switchplate structure slides back and forth between at least one reaction member housing assembly and one of the external surfaces of the handles and engages opposite ends of at least one reaction member. Sliding the switchplate structure back and forth into engagement with opposite ends of the at least one reaction member while the handles are squeezed with the holes in alignment will cause both reaction members to pivot and react so as to allow the transfer pins to be pushed into and out of the first and second operating positions.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 8 is a sectional view like FIG. 7 showing the transfer pins in the external ring mode;

FIG. 9 is a bottom view of a housing assembly forming part of the switching mechanism;

FIG. 10 is a sectional view taken on line 10—10 of FIG. 9;

FIG. 11 is a perspective view of a rocker or torsion spring used in the housing assembly;

FIG. 12 is a top plan view of a spring pin used in the spring housing assembly;

FIG. 13 is a top plan view of a switchplate used in the switching mechanism;

FIG. 14 is a sectional view taken on line 14—14 of FIG. 2 showing an external ring mode;

FIG. 15 is a sectional view like FIG. 14 showing an internal ring mode;

FIG. 16 is a bottom view showing the position of the switchplate relative to the housing assembly in the internal ring mode.

DETAILED DESCRIPTION OF THE INVENTION

Figure 1:
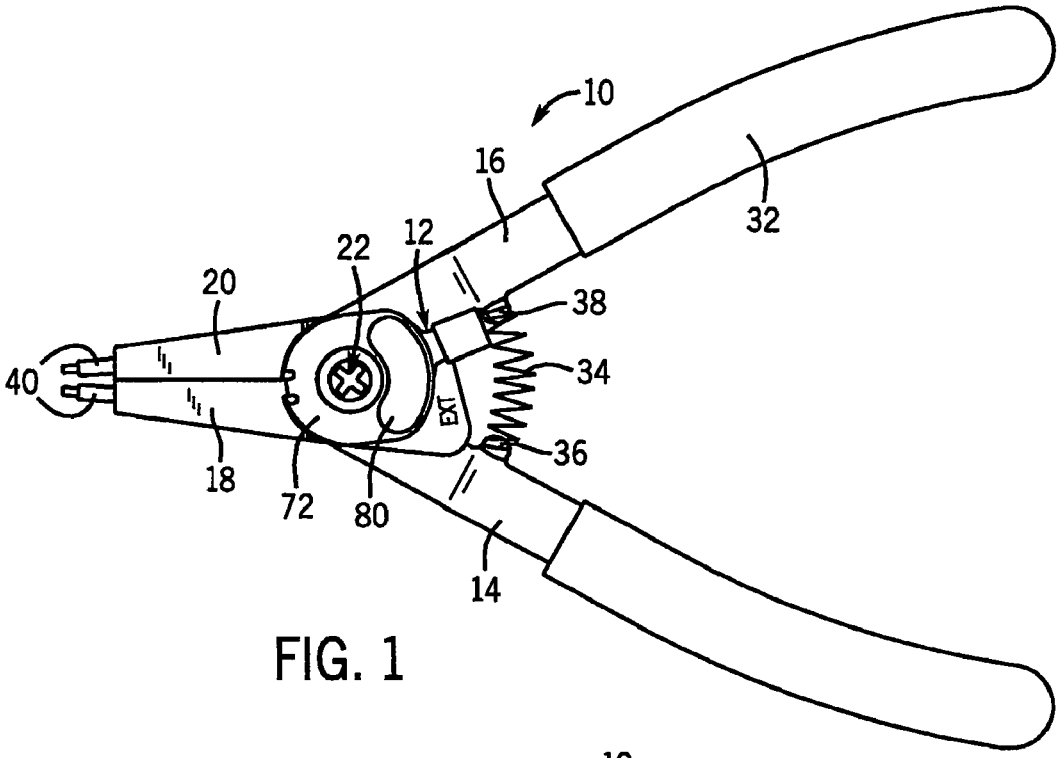
FIG. 1 is a top plan view of a retaining ring pliers having a slidable switching mechanism embodying the present invention and set in an external ring mode, the pliers being shown with its handles at rest and the jaws together.
Figure 2:
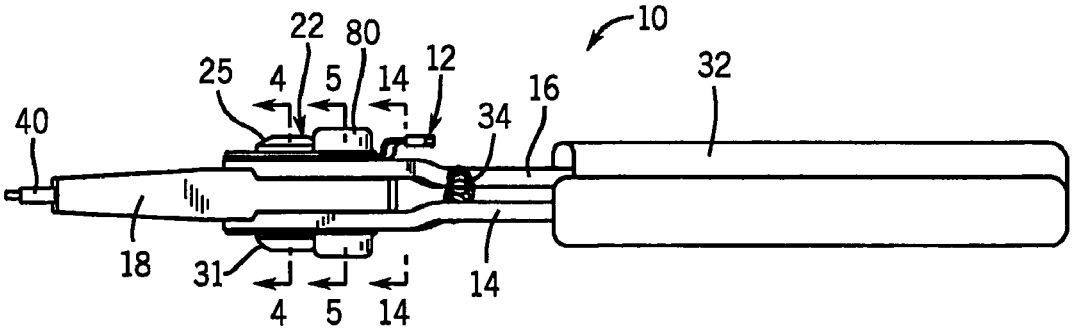
FIG. 2 is a side elevational view of FIG. 1A.
Figure 3:
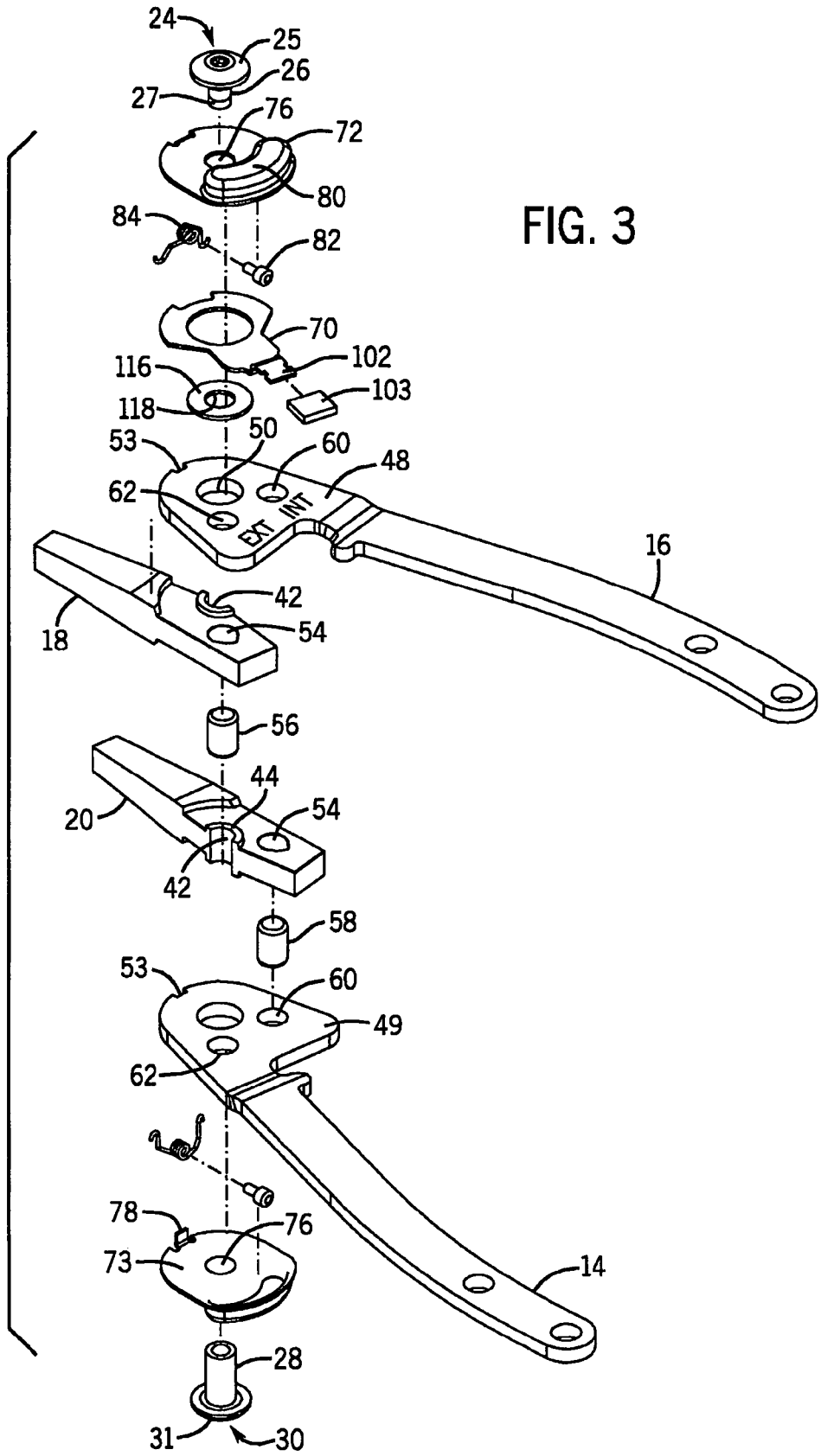
FIG. 3 is an exploded view of FIG. 1.

Referring now to FIGS. 1–3 of the drawings, thereshown is a convertible retaining ring pliers 10 provided with a slidable switching mechanism 12 embodying the present invention. The pliers 10 is generally comprised of a pair of handles 14, 16 a pair of elongated jaws 18, 20 and a pivot pin 22. The pivot pin 22 is preferably formed by a screw 24 having a head 25, a shank 26 and a threaded shaft 27 which is threadably received in a barrel 28 of a nut 30 with a head 31. The handles 14, 16 include grips 32 that provide covering to the handles which are generally manufactured of a hard metal. The handles 14, 16 are urged apart by a spring 34 disposed between two opposed lugs 36, 38 on the interior sides of both handles 14, 16. In the retaining ring pliers 10 described, the jaws 18, 20 are designed for mounting of work implements in the form of elongated retaining ring tips 40 having operator posts at the distal ends to be received in the lug holes of standard retaining rings.

Figure 4:
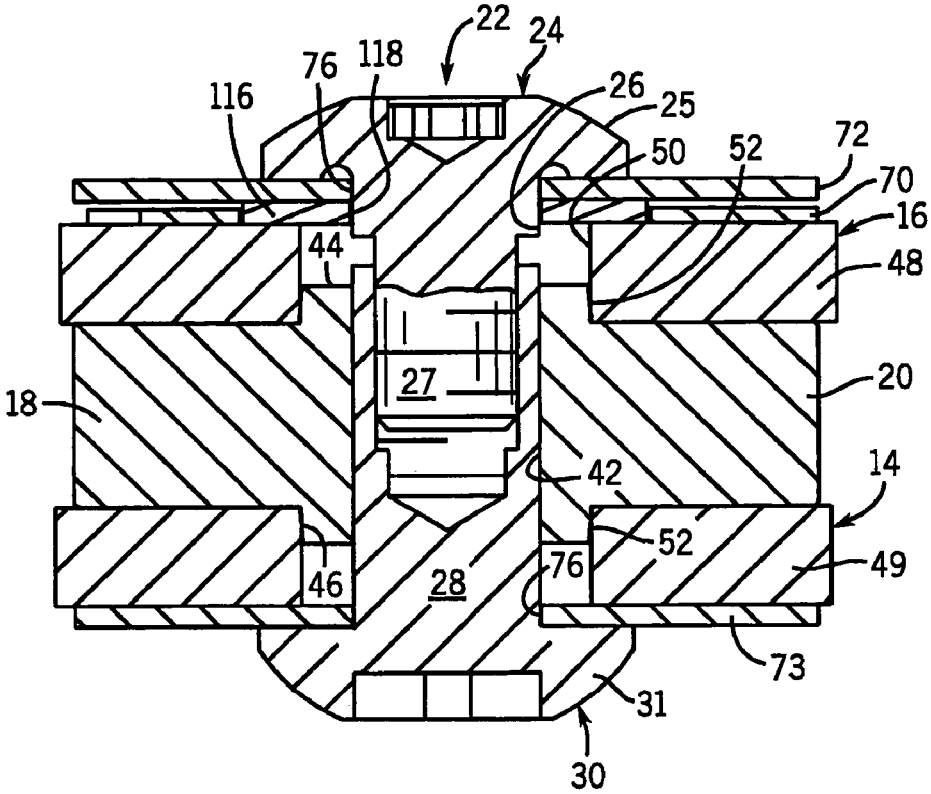
FIG. 4 is a sectional view taken on line 4—4 of FIG. 2.

As best seen in FIGS. 1, 3 and 4, the jaws 18, 20 are disposed in side-by-side relation and have transverse, cylindrically concave bearing recesses 42 for bearing engagement with a cylindrical portion of pivot pin 22. At its opposite faces, each jaw 18, 20 is provided with a projecting semicircular flange 44 which provides an external bearing shoulder 46 concentric with its bearing recess 42.

The handles 14 and 16 may be fabricated from suitable plate material, such as steel and are engaged at the opposite ends thereof to define end plates 48, 49 which are disposed parallel to each other to partially confine the jaws 18 and 20 and to enclose other components of the pliers 10 to be described.

The handle end plates 48, 49 are provided with transverse bores 50 to pass the pivot pin 22, and internal cylindrical bearing shoulders 52 for coaction with the bearing shoulders 46 of the jaws 18, 20. Through coaction then of the pivot pin 22 and the bearing shoulders 46 and 52, both jaws 18, 20 and both handles 14, 16 are mounted for rotation about a common defined axis. These principal components are maintained in the operative position by the pivot pin 22. The heads of the handle plates 48, 49 are formed with vertical channels 53 (FIG. 3) for a purpose to be appreciated hereafter.

Figure 5:
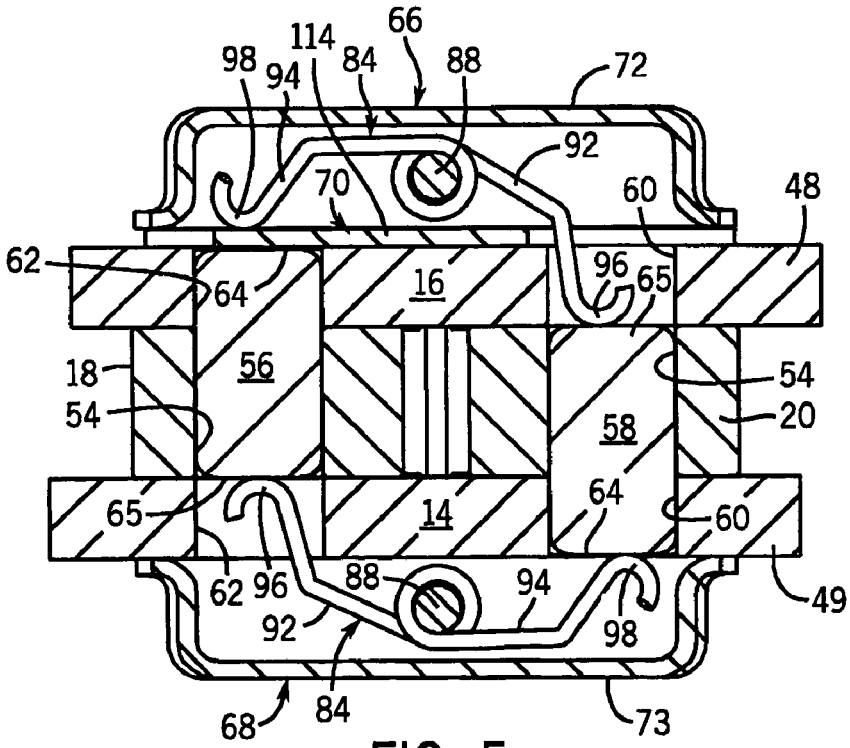
FIG. 5 is a sectional view taken on line 5—5 of FIG. 2 showing the transfer pins in the internal ring mode.
Figure 6:
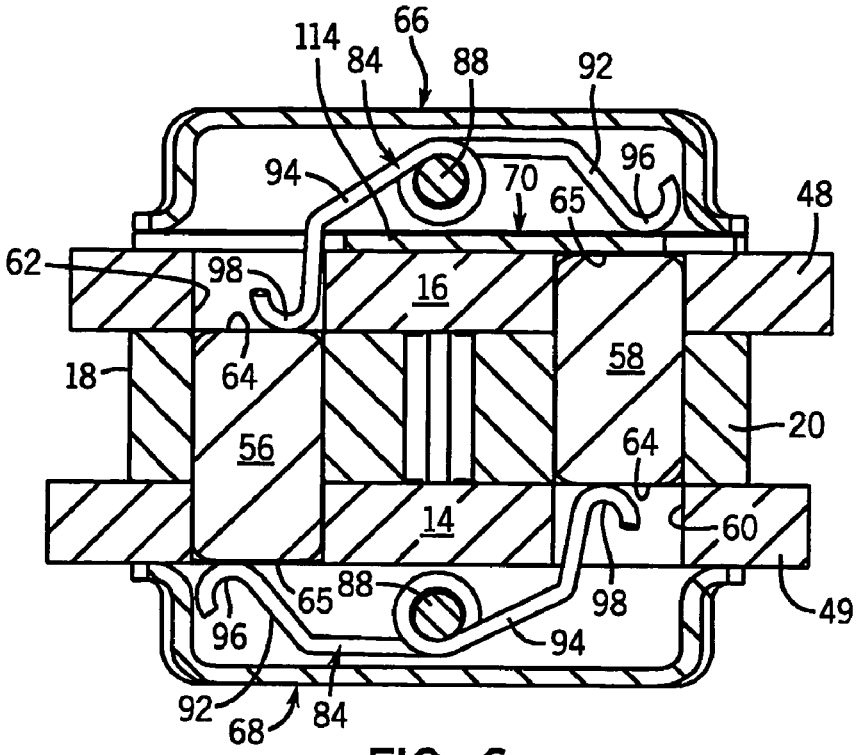
FIG. 6 is a sectional view like FIG. 5 showing the transfer pins in an external ring mode.

To effect the convertibility of the pliers 10, means are provided for coupling each of the jaws 18, 20 alternatively to one or the other of the two handles 14, 16. In this manner, each jaw 18, 20 is operatively linked to one or the other of the handles 14, 16 for oscillation therewith about the pivot 22. To accomplish this, each jaw 18, 20 is provided at its inner end with a transverse cylindrical bore 54 (FIGS. 3, 5) spaced from and parallel to its respective bearing recess 42. Elongated cylindrical transfer pins 56 and 58 are disposed in these bores 54 and are designed for a close sliding fit within the bores, as best seen in FIGS. 5 and 6.

The handle end plates 48, 49 are each provided with a pair of transverse bores 60 and 62 spaced from each other and from the pivot pin bore 50 and disposed to be axially aligned with respective bores 54 of the jaws 18, 20 in selective relative position. These handle bores 60, 62 have the same diameter as the bores 54 of the jaws 18, 20 so that when a transfer pin 56, 58 is received within a handle bore 60, 62, that handle 14, 16 is securely coupled to the respective jaw 18, 20. As best seen in FIGS. 5 and 6, the transfer pins 56, 58 have a length such that when the pin is fully confined within a jaw bore 54, it has an outermost end 64 or 65 which is flush with the external face of the handle end plate 48 or 49. In assembled relation of the pliers 10, it will be seen that the handle end plates 48, 49 are contiguous to the opposite faces of the jaws 18, 20 and maintained in that relation by the pivot pin assembly 22, and it will be seen that the transfer pins 56, 58 are designed for vertical sliding motion within aligned jaw bore 54 and respective handle end plate bores 60, 62.

Referring now to FIGS. 2 and 5–8, the slidable switching mechanism 12 is comprised of a first or upper reaction member housing assembly 66, a second or lower reaction member housing assembly 68 and a movable switchplate 70. In the preferred embodiment, the first reaction member housing assembly 66 is disposed above handle plate 48, and the second reaction member housing assembly 68 is positioned upon handle plate 49. Switchplate 70 is interposed and movably mounted between first reaction member housing assembly 66 and handle plate 48. As seen in FIGS. 3, 9 and 10, reaction member housing assemblies 66 and 68 are identical and include a respective cover 72, 73 formed by a planar thin plate having a curved periphery 74 and a central aperture 76. Each cover 72, 73 is formed on one side with a switchplate-engaging tab 78 extending at generally 90° relative to the plane of the plate, and is constructed on an opposite side with a kidney-shaped dome 80. Notches 79 are formed in each cover 72, 73 on opposite sides of tab 78 to provide material relief. Tabs 78 are designed to be aligned in the recesses 53 formed in the heads of handle plates 48, 49. The dome 80 on each cover 72, 73 defines a retaining pocket for holding a spring pin 82 and reaction member in the form of a rocker or torsion spring 84. Each spring pin 82 has a head 86 and a stem 88 of smaller diameter than the head. Each torsion spring 84 has a central coiled portion 90 integrally joined to a pair of oppositely directed spring arms 92, 94 having curled free ends 96, 98, respectively (FIGS. 5–8). The coiled portion 90 of each torsion spring 84 is rotatably disposed about the stem 88 of a respective spring pin 82 so that the spring 84 rotates with respect thereto during operation of the switching mechanism 12. As seen in FIG. 4, the shank 26 of screw 24 passes through the central aperture 76 of the first reaction member housing assembly cover 72. Similarly, the barrel 28 of nut 30 passes through the central aperture 76 of the second reaction member housing assembly cover 73. Head 25 of screw 24 engages the cover 72 of the first reaction member housing assembly 66, while head 31 of nut 30 engages the cover 73 of the second reaction member housing assembly 68.

Referring now to FIGS. 2, 3 and 13, switchplate 70 includes a first flat portion 100 which lies between the first reaction member housing assembly 66 and handle plate 48, and a second flat portion 102 offset from and lying in a horizontal plane above the horizontal plane of the first portion 100. Second portion 102 typically carries a protective covering 103 surrounding its surface area. The first portion 100 is formed with a central opening 104 and has a periphery 105 provided with a recess 106 defined by side walls 108, 110 and bottom wall 112. First portion 100 also includes an engagement surface 114 located between the opening 104 and the second portion 102. The diameter of opening 104 is larger than the diameter of aperture 76 in covers 72, 73 so that a washer 116 (FIGS. 3 and 4) can be received within the surrounding wall forming opening 104. The washer 116 has a hole 118 throughwhich the screw shank 26 passes.

Figure 1A:
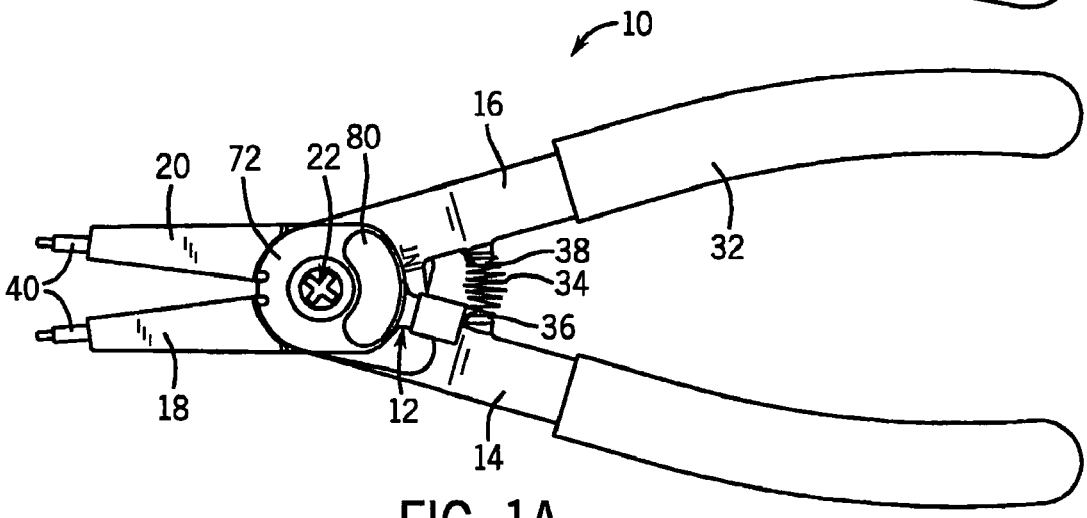
FIG. 1A is a view like FIG. 1 but set in an internal ring mode showing disposition of the handles with a slight squeezing pressure having been applied thereto.

It is important to note that the thickness of washer 116 is slightly greater than the thickness of switchplate 70 in surrounding relationship therewith. As a result of this structure, the switchplate 70 is slidably mounted for limited rotation about washer 116 between cover 72 and handle plate 48. At the same time, clamping pressure is applied to the threaded screw 24 through the inner portion of the cover 72, and washer 116 onto handle plate 48 in a manner which will hold the pliers 10 together without impeding the movement of the switchplate 70. As seen in FIGS. 1, 1A and 2, second portion 102 of switchplate 70 extends beyond the periphery of cover 72 and defines an actuator for easily moving the switchplate 70 from side-to-side using a single finger, such as one's thumb, while the pliers is being held. The side-to-side travel of the switchplate 70 is limited by the engagement of the tab 78 and cover 72 with either of the switchplate side walls 108, 110.

As will now be described through the coaction of the switching mechanism 12, the pivot assembly 22 and the transfer pins 56, 58, each jaw 18 or 20 may be selectively rigidly linked or coupled to a selected handle 14 or 16.

The described convertible retaining ring pliers 10 is adapted for two operational modes which may be referred to as "the external ring mode" and the "internal ring mode". Referring now to FIGS. 1 and 3, a legend "EXT" is imprinted on the end plate 48 of the handle 16 adjacent to the bore 62 which is positioned to receive the transfer pin 56, and the legend "INT" is placed on the end plate 48 adjacent to the bore 60 which is positioned to receive the transfer pin 58. In the external mode then, the switchplate actuator 102 is shifted to cover the INT legend and with the EXT legend visible informs the user that the pliers 10 is in the "external ring mode". Similarly, when the pliers 10 is in the "internal ring mode", switchplate actuator 102 covers the EXT legend and provides the visible INT legend "internal ring mode" indication to the user.

FIGS. 1, 6, 8 and 14 particularly illustrate the external ring mode. In this mode, the jaw 18 is coupled to the handle 14, and the jaw 20 is coupled to the handle 16 so that squeezing of the handles toward each other will result in corresponding divergence of the tips 40 away from each other. Switchplate 70 is slidably positioned by moving actuator 102 so that side wall 110 engages tab 78 on upper reaction member housing assembly 66 (FIG. 9).

It will be appreciated that a portion of the engagement surface 114 on switchplate 70 (as set forth in the at rest position in FIG. 1) holds up the curled end 96 of spring arm 92 in upper reaction member housing assembly 66 as seen in FIG. 8. The spring 84 in upper reaction member housing assembly 66 is loaded tortionally and the curled end 98 of spring arm 94 is biased downwardly into the bore 62. Movement of the curled end 98 of spring arm 94 is stopped by the jaw 18. As the handles 14, 16 are squeezed together (FIG. 6), the curled end 98 of spring arm 94 holds the end 64 of transfer pin 56 down at a level which is flush with the bottom surface of handle plate 48 and the top surface of jaw 18. Pressure transferred from the spring 84 in upper reaction member housing assembly 66 through the transfer pin 56 has placed the spring 84 in lower reaction member housing assembly 68 into torsional loading, and the curled end 98 of spring arm 94 in lower reaction member housing assembly 68 has moved upwardly into bore 60. Movement of the transfer pin 58 is stopped by the bottom of spring plate engagement surface 114. As the handles 14, 16 are squeezed together, the curled end 98 of spring arm 94 holds the transfer pin 58 up at a level that is flush with the bottom surface of jaw 20 and the top surface of handle plate 49.

When it is desired to convert the pliers 10 to the internal ring mode, the pliers 10 are held at rest and the user simply uses one finger, such as a thumb, to slide the switchplate actuator 102 to the left (FIG. 15) so that it covers the EXT legend. Switchplate 70 is slidably positioned so that the side wall 108 engages tab 78 of upper reaction member housing assembly 66 as seen in FIG. 16. As the pliers handles 14, 16 are gently squeezed together, a clicking can be sensed as the transfer pins 56, 58 change position. Now with the handles 14, 16 at rest, the jaws 18, 20 will be apart. Squeezing the handles 14, 16 will now enable the tips 40 to come together.

Figure 7:
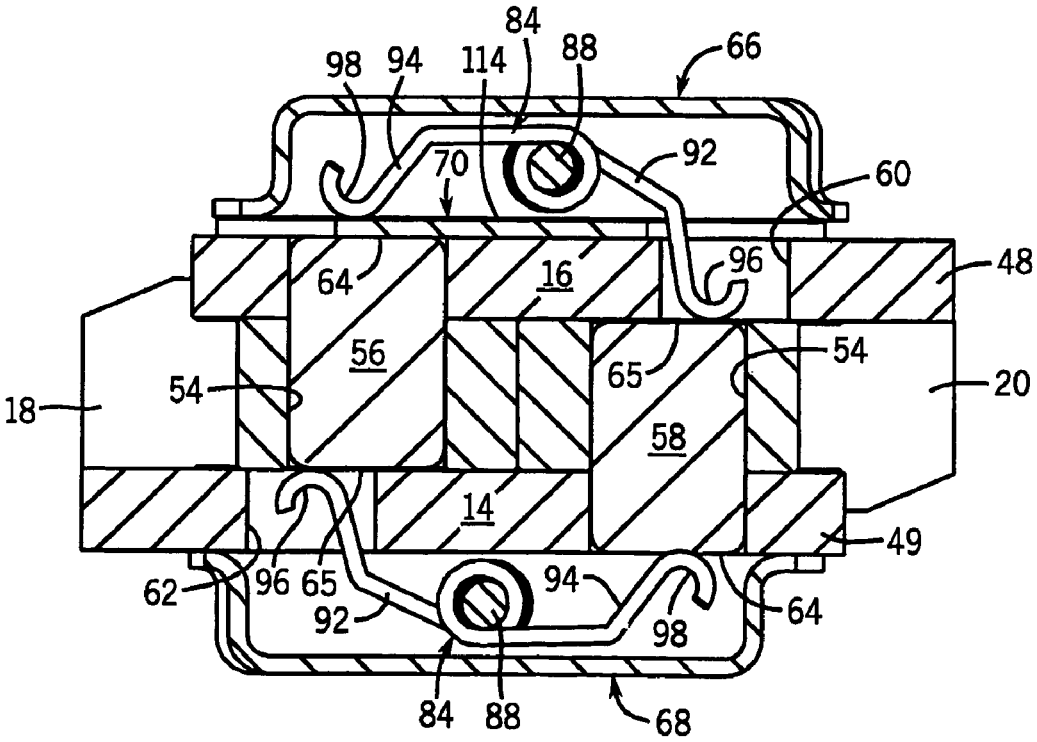
FIG. 7 is a sectional view similar to FIG. 5 showing the transfer pins in the internal ring mode with the plier's handles at rest.

Moving the switchplate 70 from right to left does not actually convert the pliers 10 from external to internal ring mode. Rather, it sets up the mechanism to make the conversion once the respective bores 54, 60 and 62 are aligned. Shifting of the switchplate 70 lifts the curled end 98 of spring arm 94 of spring 84 in the upper reaction member housing assembly 66 out of the bore 62, and releases the curled end 96 of spring arm 92 to put pressure on the transfer pin 58, but the pin 58 cannot move. As the handles 14, 16 are squeezed together (FIG. 5), the bores 54 in the jaws and the bores 60, 62 in the handle plates 48, 49 will all come into alignment at the same moment. When the bores 54, 60, 62 are aligned, the spring 84 in upper reaction member housing assembly 66 will push the transfer pin 58 out of engagement with the handle plate 48 and jaw 20 and into engagement with handle plate 49 and jaw 20. The transfer pin 58 puts pressure on spring 84 in the lower reaction member housing assembly 68 which pushes the transfer pin 56 up to engage handle plate 48 and jaw 18. The transfer pin 56 moves up freely because the switchplate 70 is holding up the curled end 98 of spring arm 94 in upper reaction member housing assembly 66. The upward movement of transfer pin 56 is stopped by contact with the bottom of switchplate 70. The pliers 10 at rest and now in the internal ring mode appears as shown in FIG. 7.

When it is desired to convert back to the external ring mode, the user slides the switchplate actuator 102 to the right so that it covers the INT legend. Again, side wall 110 engages tab 78 of upper reaction member housing assembly 66. As the pliers 10 are gently squeezed together, a clicking again is sensed as the transfer pins 56, 58 change position. When the handles 14, 16 are released, a further clicking may be heard as the transfer pins 56, 58 finish changing position.

Now with the handles 14, 16 at rest, the jaws 18, 20 will be together in the external ring mode. Squeezing the handles 14, 16 together will move the tips 40 apart. As before, the movement of switchplate 70 from left to right does not actually convert the pliers 10 from internal to external ring mode. It sets up the mechanism to make the conversion once the bores 54, 60, 62 are aligned. Shifting of the switchplate 70 lifts the curled end 96 of spring arm 92 of spring 84 in the upper reaction member housing assembly 66 out of bore 60, and releases the curled end 98 of spring arm 94 to put pressure on the transfer pin 56, but the pin 56 cannot move. As the handles 14, 16 are squeezed together (FIG. 6), the bores 54 in jaws 18, 20 and bores 60, 62 in handle plates 48, 49 will all come into alignment at the same time. When the bores 54, 60, 62 are aligned, the spring 84 in upper reaction member housing assembly 66 will push the transfer pin 56 out of engagement with the handle plate 48 and jaw 18, and into engagement with handle plate 49 and jaw 18. The transfer pin 56 puts pressure on spring 84 in lower reaction member housing assembly 68 which pushes transfer pin 58 up to engage handle plate 48 and jaw 20. The transfer pin 58 moves upwardly freely because the switchplate 70 is holding up the spring arm 92 of spring 84 in upper reaction member housing assembly 66. The upward movement of the transfer pin 58 is stopped by contact with the bottom of switchplate 70. The pliers 10 at rest now appears as in FIG. 8.

It should now be appreciated that the switching mechanism 12 performs two functions incidental to the operation of pliers 10. One function is that the position of slidable switchplate 70 coacting with the legend provided on the external handle surface provides a visual indication of the operating mode or position of the pliers 10. Another function is the convenience of shifting the transfer pins 56, 58 to convert the pliers to an alternative operational mode. During that shifting, the transfer pins 56, 58 are readily and simultaneously moved into their desired positions without need for an additional implement or applying finger pressure directly to the transfer pins of 56, 58. Sliding the switchplate 70 back and forth into engagement with opposite ends of one spring 84 while the handles 14, 16 are squeezed, will cause both springs 84 to pivot and react so as to cause the transfer pins 56, 58 to be pushed into and out of their respective handle bores 60, 62. The springs 84 and slidable switchplate 70 also function to hold the transfer pins 56, 58 in alignment and engagement with the bores 60, 62 depending upon the desired position of the pliers 10.

Figure 17:
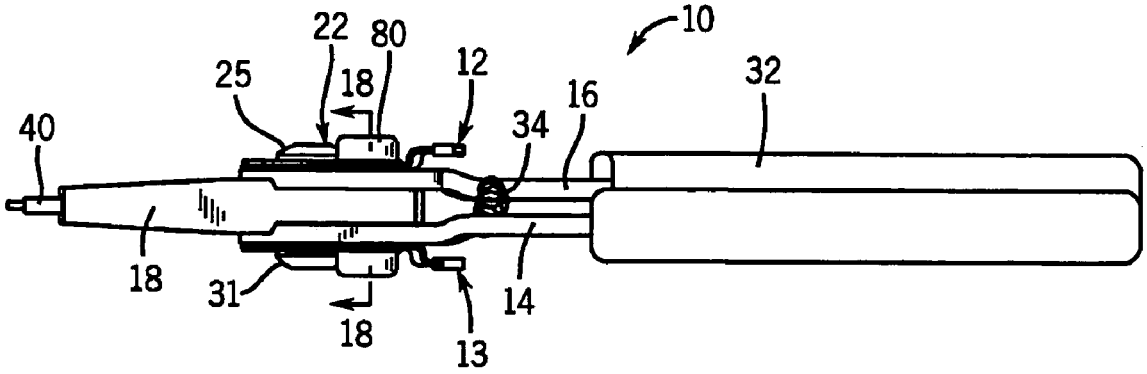
FIG. 17 is a side elevational view similar to FIG. 2 showing an alternative embodiment which utilizes a switching mechanism provided with two switchplates.
Figure 18:
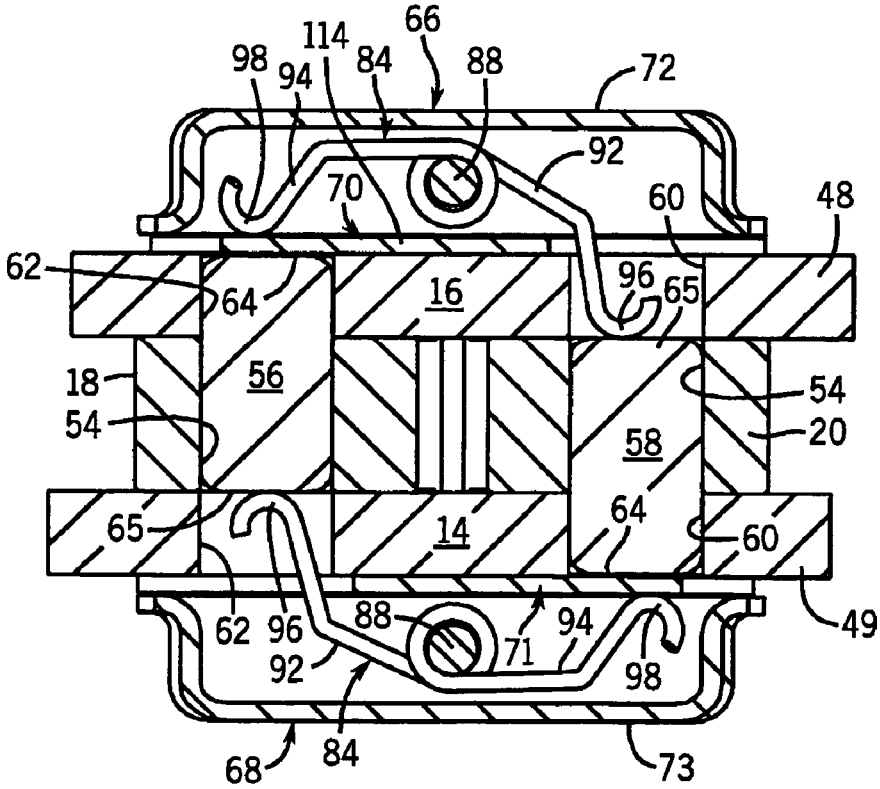
FIG. 18 is a sectional view similar to FIG. 5 showing the embodiment of FIG. 17.
Figure 19:
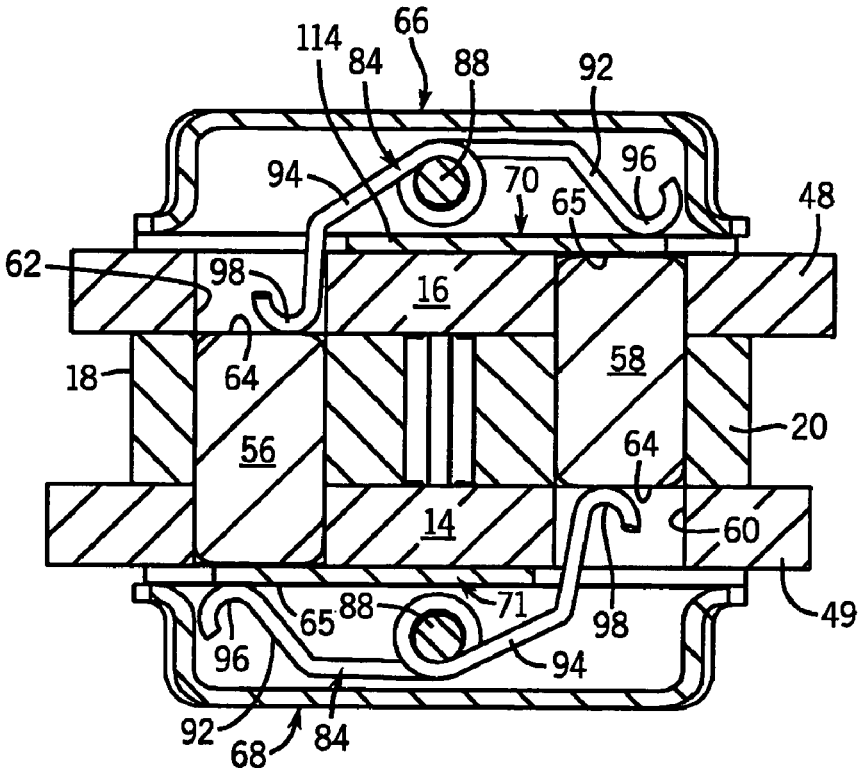
FIG. 19 is a sectional view similar to FIG. 6 showing the embodiment of FIG. 17.
Figure 20:
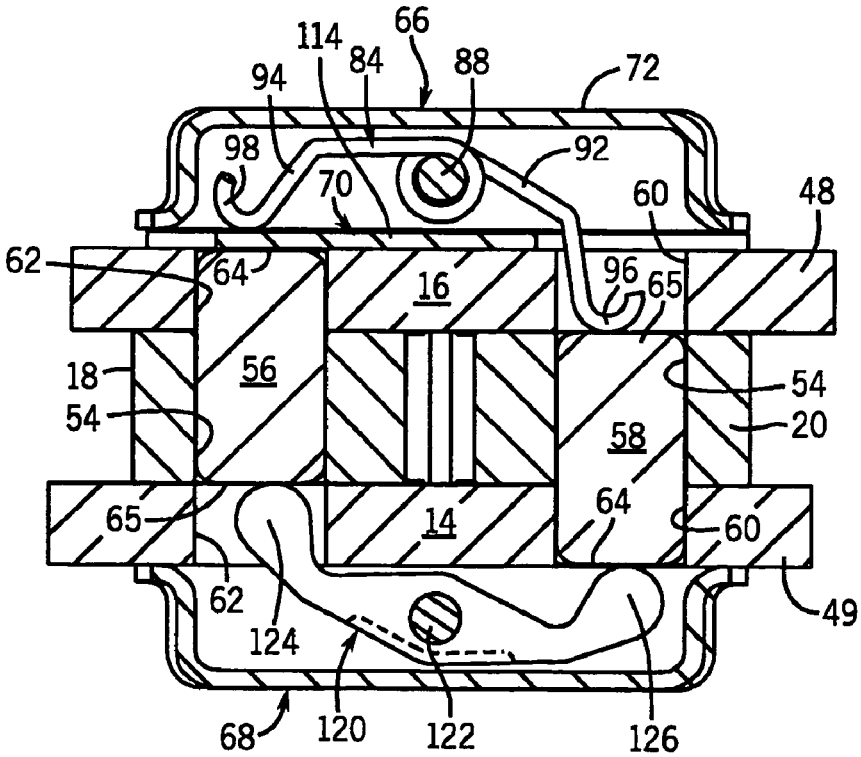
FIG. 20 is a sectional view like FIG. 5 showing another alternative embodiment which utilizes a solid rocker member in place of a spring in the lower housing.

While the invention has been described with reference to the preferred embodiment, those skilled in the art will appreciate that certain substitutions, alterations and omissions may be made without departing from the spirit throughout. For example the invention contemplates an alternative embodiment using two identical switching mechanisms 12 and 13 wherein two identical switchplates 70, 71 are used such as illustrated in FIGS. 17, 18 and 19. Overall structure follows from the description above, it being understood that both switchplates 70, 71 are manually positioned together in either the external or internal ring mode. Another alternative embodiment is shown in FIG. 20 wherein a solid non-flexing rocker 120 is used in place of spring 84 in lower housing assembly 68 and defines the lower reaction member. The rocker 120 pivots about a pin 122 and has rigid free ends 124, 126 which engage bottom ends of transfer pins 56, 58, respectively. The rigid free ends 124, 126 move similar to spring ends 96, 98, however, they provide a more precise movement to give better control of the switching mechanism 12. Accordingly, the foregoing description is meant to be exemplary only and should not be deemed limitative on the scope of the invention set forth with the following claims.

We claim:

1. In a pliers comprising means defining a pivot means, first and second jaws arranged for oscillation toward and away from each other about the pivot means, first and second handles arranged for oscillation toward and away from each other about the pivot means, the handles having portions adjacent to the pivot means disposed on respective opposite sides of the jaws, a transfer pin slidably disposed in each jaw for alternative engagement with one or the other of the handle portions, the transfer pins being disposed in transverse bores of the jaws having axes parallel to the axis of the pivot means, each of the handle portions having a pair of spaced holes disposed to receive the transfer pin, the transfer pins in the first and second jaws being selectively slidably engaged in the holes of respective first and second handles to effect movement of the jaws toward each other when the handles are moved toward each other to define a first operating position, and the transfer pins in the first and second jaws being selectively engaged in the holes of respective second and first handles to effect movement of the jaws away from each other as the handles are moved toward each other to define a second operating position, the improvement comprising:

a switching mechanism mounted to the pivot means and in contact with external surfaces of the handle portions and the transfer pins for enabling simultaneous shifting of the transfer pins in the first and second jaws and holes of the first and second handles, the switching mechanism including a first reaction member housing assembly associated with the external surface of one handle portion, a second reaction member housing assembly associated with the external surface of the other handle portion and a switchplate structure rotatably mounted for side-to-side movement about the pivot means and slidably positioned between at least one reaction member housing assembly and one of the external surfaces of the handle portions, the switchplate structure being engagable with an internal portion and an external portion of the at least one reaction member housing assembly and an end of one of the transfer pins.

2. The improvement of claim 1, wherein each reaction member housing assembly includes a cover provided with a domed portion for retaining a reaction member having a central portion rotatably mounted about a pin.

3. The improvement of claim 2, wherein each reaction member is a spring having a coiled central portion.

4. The improvement of claim 3, wherein the spring further includes a pair of oppositely extending spring arms joined to the coiled central portion.

5. The improvement of claim 4, wherein each spring arm terminates in a curled end.

6. The improvement of claim 5, wherein each curled end of the spring in the second reaction member housing assembly is engaged with one of the transfer pins.

7. The improvement of claim 2, wherein each cover includes a thin plate having a central aperture for receiving the pivot means, and a switchplate-engaging tab extending generally perpendicular from the thin plate.

8. The improvement of claim 7, wherein each handle is formed with a vertical channel for receiving the tab therein.

9. The improvement of claim 5, wherein one curled end of the spring in the first reaction member housing assembly is engaged with the switchplate structure, and the other curled end of the spring in the first reaction member housing assembly is engaged with a transfer pin.

10. The improvement of claim 7, wherein the switchplate structure has a first flat portion lying between the cover and the external surface of the one handle portion, and a second flat portion extending from the first flat portion and defining an actuator adapted to be engaged by a single finger when it is desired to move the switchplate structure.

11. The improvement of claim 10, wherein the switchplate structure is formed with a recess having a pair of spaced apart side walls, each of which is engagable with the tab on the cover when the switchplate structure is moved from side-to-side.

12. The improvement of claim 1, wherein the switchplate structure includes one switchplate disposed between the first reaction member housing assembly and the external surface of one handle portion.

13. The improvement of claim 1, wherein the switchplate structure includes one switchplate disposed between the first reaction member housing assembly and the external surface of one handle portion, and another switchplate disposed between the second reaction member housing assembly and the external surface of another handle portion.

14. The improvement of claim 1, wherein one of the reaction member housing assemblies includes a spring rotatably mounted about a first pin, and the other of the reaction member housing assemblies includes a solid non-flexing rocker pivotably mounted about a second pin.

15. A convertible retaining ring pliers comprising:

a pivot;

first and second jaws rotatably joined about the pivot;

first and second handles rotatably secured about the pivot;

a pair of transfer pins slidably disposed for selective movement in the first and second jaws and first and second handles for establishing a first operating position enabling the jaws to move inwardly as the handles move inwardly, and a second operating position allowing the jaws to move outwardly as the handles move inwardly; and a switching mechanism mounted to the handles and pivot for providing simultaneous shifting of the transfer pins in the jaws and handles between the first and second operating positions, the switching mechanism including a first reaction member housing assembly mounted to one end of the pivot and associated with an external surface of the first handle, a second reaction member housing assembly mounted to an opposite end of the pivot and associated with an external surface of the second handle, and a switchplate structure rotatably mounted about the pivot and slidably positioned between at least one reaction member housing assembly and one of the external surfaces of the one handle portions, each reaction member housing assembly having a cover for retaining a spring having a central coiled portion with a pair of oppositely extending spring arms, and a spring pin about which the coiled portion of the spring is rotatably disposed, whereby in each operating position, the switchplate structure is engaged with one of the spring arms, the cover of at least one reaction member housing assembly and an end of one of the transfer pins.

16. The pliers of claim 15, wherein the switchplate structure includes one switchplate disposed between the first reaction member housing assembly and the external surface of one handle portion.

17. The pliers of claim 15, wherein the switchplate structure includes one switchplate disposed between the first reaction member housing assembly and the external surface of one handle portion, and another switchplate disposed between the second reaction member housing assembly and the external surface of another handle portion.

18. A method of converting a retaining ring pliers having a pivot, first and second jaws rotatably secured about the pivot, first and second handles rotatably joined about the pivot, and a pair of transfer pins slidably disposed for selective movement in the first and second jaws and the first and second handles between one operating position enabling the jaws to move inwardly as the handles move inwardly, and a second operating position enabling the jaws to move outwardly as the handles move inwardly, the method comprising the steps of:

mounting a first reaction member housing assembly having a first reaction member with opposite ends to one end of the pivot such that the first reaction member housing assembly is disposed above an external surface of the first handle;

mounting a second reaction member housing assembly having a second reaction member with opposite ends to an opposite end of the pivot such that the second reaction member housing assembly is disposed on an external surface of the second handle and the opposite ends of the second reaction member are engagable with ends of the transfer pins; and mounting a switchplate structure for limited rotation about the pivot so that the switchplate structure slides back and forth between at least one reaction member housing assembly and one of the external surfaces of the handles, and engages opposite ends of at least one of the reaction members, wherein sliding the switchplate structure back and forth into engagement with opposite ends of the at least one of the reaction members while the handles are squeezed will cause both reaction members to pivot and react to push the transfer pins into and out of the first and second operating positions.

* * * * *